US007201300B2

(12) United States Patent
Buri et al.

(10) Patent No.: US 7,201,300 B2
(45) Date of Patent: Apr. 10, 2007

(54) DEVICE FOR DEFLECTING A WEB

(75) Inventors: Daniel Buri, Wynigen (CH); Thomas Seiler, Thun (CH)

(73) Assignee: WIFAG Machinenfabrik (CH)

( * ) Notice: Subject to any disclaimer, the term of this patent is extended or adjusted under 35 U.S.C. 154(b) by 383 days.

(21) Appl. No.: 10/785,265

(22) Filed: Feb. 24, 2004

(65) Prior Publication Data

US 2004/0164477 A1 Aug. 26, 2004

(30) Foreign Application Priority Data

Feb. 25, 2003 (DE) ..... 103 07 992

(51) Int. Cl.
*B65H 23/04* (2006.01)
*B65H 23/24* (2006.01)

(52) U.S. Cl. ..... 226/196.1; 242/615.12; 242/615.21

(58) Field of Classification Search ..... 226/196.1; 242/615.12, 615.21, 615.2, 615.1; 270/52.08; 493/438

See application file for complete search history.

(56) References Cited

U.S. PATENT DOCUMENTS

| | | | | |
|---|---|---|---|---|
| 2,284,318 A | | 5/1942 | Hamlin | |
| 3,623,645 A | * | 11/1971 | Klingler | 242/615.21 |
| 3,734,487 A | * | 5/1973 | Treff | 270/52.08 |
| 5,016,801 A | * | 5/1991 | Gilat et al. | 242/615.21 |
| 5,100,117 A | | 3/1992 | Hajek et al. | |
| 5,108,022 A | * | 4/1992 | Birkmair et al. | 242/615.21 |
| 5,357,859 A | * | 10/1994 | Eckert | 101/228 |
| 5,520,317 A | * | 5/1996 | Eckert et al. | 242/615.12 |
| 5,823,464 A | * | 10/1998 | Bohn et al. | 242/615.21 |
| 6,013,212 A | * | 1/2000 | Planeta et al. | 264/40.7 |
| 6,047,922 A | * | 4/2000 | Michalik | 242/615.21 |
| 6,450,382 B1 | * | 9/2002 | Ohno | 226/21 |
| 6,695,250 B2 | * | 2/2004 | Michalik et al. | 242/615.21 |
| 6,820,839 B2 | * | 11/2004 | Weis | 242/615.21 |

FOREIGN PATENT DOCUMENTS

DE 93 20 281.4 4/1994

* cited by examiner

*Primary Examiner*—Emmanuel Marcelo
*Assistant Examiner*—Evan H. Langdon
(74) *Attorney, Agent, or Firm*—McGlew & Tuttle, PC

(57) ABSTRACT

A device for deflecting a web has at least one turning bar (1; 2) that can be shifted. A first turning bar holding device (11*a*, 11*b*; 11*a*, 11*b*, 11*c*) is connected with an axial end of the turning bar. A second turning bar holding device (12) is connected with the other axial end of the turning bar. A first guide is provided, along which the first turning bar holding device (11*a*, 11*b*; 11*a*, 11*b*, 11*c*) is guided movably. A second guide (22) is provided, along which the second turning bar holding means (12) is guided movably. An adjusting device (19, 20) is provided, by which at least one (11*a*, 11*b*; 11*a*, 11*b*, 11*c*) of the turning bar holding means is adjustable along its guide (21) in order to position it (11*a*, 11*b*; 11*a*, 11*b*, 11*c*) for shifting the turning bar (1; 2). A connection of the turning bar (1; 2) with the first turning bar holding device (11*a*, 11*b*; 11*a*, 11*b*, 11*c*) can be separated manually and can be established manually in order to make it possible to manually separate the turning bar (1; 2) from the first turning bar holding device(11*a*, 11*b*; 11*a*, 11*b*, 11*c*) and to connect it manually with the positioned first turning bar holding device (11*a*, 11*b*; 11*a*, 11*b*, 11*c*) during the shifting.

23 Claims, 11 Drawing Sheets

DEVICE FOR DEFLECTING A WEB

CROSS REFERENCE TO RELATED APPLICATIONS

This application claims the benefit of priority under 35 U.S.C. § 119 of German patent application DE 103 07 992 filed Feb. 25, 2003, the entire contents of which are incorporated herein by reference.

FIELD OF THE INVENTION

The present invention pertains to a device for deflecting a web, preferably for turning and/or turning around. The device has at least one turning bar that can be shifted.

BACKGROUND OF THE INVENTION

Turning bars are used in machines that treat or process web-like material for turning or turning around a web or simply to deflect the web in relation to its direction of delivery, e.g., by 90°. Prominent examples of such machines are web-fed rotary printing presses to which the present invention also preferably pertains. To make it possible to increase the flexibility in bringing together a plurality of webs, whose definition will also cover strands of a web cut lengthwise below, or to change only the new direction in the case of a simple change in direction, the turning bars of an arrangement comprising a plurality of turning bars or only individual turning bars of the arrangements or optionally also only a single one of the turning bars can be shifted. The property of shiftability means that the turning bar in question can be moved from a starting position, which it assumes in the plane of the web, into a new position in the plane of the web, in which it points in the direction of delivery at a different angle than in the starting position. In general, turning bars of web-fed rotary printing presses point at an angle of 45° to the direction of delivery of the entering web and are turned or pivoted by 90° during the deflection, so that they point at an angle of 135° to the direction of delivery of the entering web after the deflection.

The shifting of turning bars causes problems especially in web-fed rotary printing, toward which the present invention is preferably but not exclusively directed. In web-fed rotary printing presses, the turning bars are used to bring together a plurality of webs. A plurality of turning bars are often accommodated in such an arrangement in a compact manner in a very small space. When the press is changed over from one printed product to another printed product, e.g., from one newspaper product to another newspaper product, a plurality of turning bars and possibly all turning bars of the arrangement must be shifted in order to adapt the arrangement to new web paths. The configuration is time-consuming and therefore expensive last but not least because of the poor accessibility to the individual turning bars.

Turning bars that can be shifted automatically, as they are known from, e.g., DE 43 11 437 A1, eliminate these drawbacks, but they are associated with a great mechanical and control engineering effort. A plurality of motors are needed to shift a turning bar, and a movement of the turning bars in relation to two axes of movement, which movements are generated by the motors, must be coordinated with each other. A corresponding effort is also needed for the mounting of the turning bar.

SUMMARY OF THE INVENTION

One object of the present invention to reduce the technical effort needed for the rapid shifting of a turning bar.

The present invention pertains to a device for deflecting a web, preferably for turning and/or turning around a web. The device comprises at least one shiftable turning bar. If the device is a device for turning and/or turning around a web, the device comprises at least one additional turning bar, which is preferably also shiftable, but does not have to be. For turning around a web, a deflecting means, which is arranged on the side of the pair of turning bars and to which the web exiting one turning bar is delivered and is returned while wrapping around the lateral deflecting means and is led over the other turning bar of the pair, preferably also belongs to the at least one pair of turning bars. The device especially preferably comprises a plurality of pairs of turning bars and even more preferably at least one such lateral deflecting means each per pair of turning bars. Each of the pairs of turning bars and the lateral deflecting means optionally provided per pair may be integrated especially in one level, in which case the device has two, three or even more levels of this type arranged one on top of another.

For the at least one shiftable turning bar, the device comprises, furthermore, a first turning bar holding means, which is connected to one axial end of the turning bar, a first guide, along which the first turning bar holding means is guided movably, and, furthermore, another, second turning bar holding means, which is connected to the other axial end of the turning bar, and a second guide, along which the second turning bar holding means is guided movably. The turning bar thus extends between the two guides pointing at right angles to the turning bar and can be adjusted along the guides. The guides are preferably straight guides and may extend especially in or in parallel to the plane of the web, preferably horizontally.

The device comprises, furthermore, an adjusting means for at least one of the two turning bar holding means. The turning bar holding means in question is adjustable along its guide by means of the adjusting means in order to reposition it for the shifting of the turning bar. The adjusting means may be coupled with both turning bar holding means for adjusting these means. It is preferably coupled with only one of the two. The first adjusting means is especially preferably adjustable by means of the adjusting means.

The connection between the turning bar and the first turning bar holding means can be severed manually and also be established manually. The connection is preferably formed as a quick acting closure, which can be quickly released and also quickly established without auxiliary means. During shifting, the turning bar is manually separated from the first turning bar holding means in a first step. The connection between the turning bar and the second turning bar holding means is maintained during the shifting operation. In this sense, it is a permanent connection, which is preferably severed only for the replacement of the turning bar.

After the separation, the first turning bar holding means is adjusted from a starting position, which it assumes before the shifting, along the first guide into the preset new position, which determines the orientation of the shifted turning bar. The adjustment and the positioning, i.e., the fixation in the new position, is preferably brought about by the adjusting means. After the separation and before, after or preferably during the positioning of the first turning bar holding means, the second turning bar holding means is moved along the second guide into its new position, which can be brought about advantageously by a corresponding handling of the turning bar in the case of the manual adjustment preferred for the second turning bar holding means. If the adjusting means brings about the adjustment of the second turning bar holding means, the turning bar is held by the human operator during the adjustment. The new position of the turning bar holding means to be adjusted manually is preset by the overall length of the turning bar extending between the guides and by the two adjoining turning bar holding means. After the second turning bar holding means has been moved into its new position, the still free end of the turning bar, which end faces the first guide, is again fixed manually at the first guide. The fixing is brought about by the turning bar being connected to the first turning bar holding means.

The first turning bar holding means may be formed by a single first turning bar holder. However, the first turning bar holding means preferably comprises at least two first turning bar holders, which are designed each such that the shiftable turning bar can be connected manually with each of the first turning bar holders and can be manually separated from the first turning bar holder in question. The at least two first turning bar holders form at least one, and preferably only one connection point each for the connection with the turning bar, and the connection points have an identical design or are identical at least to the extent that the connection with the turning bar can be established and severed with the same movements.

In preferred embodiments, the two or even more first turning bar holders are guided movably along the first guide and can be adjusted together by means of the adjusting means.

If the first turning bar holding means comprises at least two first turning bar holders as described, the turning bar is connected before the shifting with one of the at least two first turning bar holders, while it is preferably connected with the other of the at least two first turning bar holders after the shifting. The first turning bar holding means is correspondingly adjusted, preferably by means of the adjusting means, such that the one turning bar holder of the at least two first turning bar holders that was not connected with the turning bar before the shifting is adjusted into the new position and is subsequently connected to the turning bar. Compared to a device with only a single first turning bar holder per turning bar, the path of adjustment can be shortened and the adjustment time correspondingly reduced due to the arrangement of two or even more first turning bar holders per shiftable turning bar, which are adjusted together by means of the adjusting means so that one of the first turning bar holders will assume the new position.

The adjustment of the turning bar holding means adjustable by means of the adjusting means is preferably brought about by means of a motor. A separate, own adjusting motor is preferably provided here per shiftable turning bar. The adjusting motor or, in the case of a plurality of shiftable turning bars, the correspondingly larger number of adjusting motors acts/act on the turning bar holding means preferably via a gear mechanism each. A threaded spindle and the turning bar holding means preferably form a screw joint, or the plurality of turning bar holders of the turning bar holding means in question form a screw joint each. Such a motor may have the threaded spindle associated with it directly as a rotor or be preferably coupled with the threaded spindle via another gear mechanism. It is, in principle, also possible to provide a hand crank, which likewise acts on the turning bar holding means associated with it via a threaded spindle in a preferred embodiment, instead of an adjusting motor. An adjusting means that can be actuated manually may also act on the associated turning bar holding means via a linkage of bars, though this is less preferred, instead of via a threaded spindle. This also applies, in principle, to the preferred motor adjustment, for example, in the case of motor adjustment by means of a linear drive.

The present invention combines the advantages of the purely manual and fully automatic shifting of turning bars, but at the same time it avoids essential drawbacks of both methods. Thus, the operator does not need to separate both ends of the bar from their respective holding means for shifting the turning bar, as this is common in the purely manual process, but the operator only needs to separate one end from the first turning bar holding means, while the connection is maintained at the other end of the turning bar. The adjustment of the turning bar holding means coupled with the adjusting means is carried out either automatically or it may be carried out manually, e.g., from a side wall of a frame carrying the guides. Subsequently or during the adjustment of the turning bar holding means in question, holding the loose end of the turning bar, the operator can direct the second turning bar holding means into its new position by means of the turning bar if the position must be changed. The turning bar itself is used as an adjustment linkage of bars via the articulated connection with the second turning bar holding means. If the second turning bar holding means is adjusted by means of the adjusting means or another adjusting means, the operator only needs to hold the separated turning bar and to adjust the first turning bar holding means if this is not adjusted automatically.

In preferred embodiments, the connection between the turning bar and the first turning bar holding means is a snap-in connection. If a plurality of first turning bar holders are associated with the turning bar, each of these first turning bar holders is designed for receiving a snap-in connection with the turning bar.

The snap-in connection is preferably designed as a quick acting closure, which permits quick release and quick establishment of the connection manually without auxiliary means. The quick acting closure is preferably formed by a mount, which is open on one side, and a connecting element that can be accommodated in the mount. The mount may be provided at the end of the turning bar and the connecting element at the first turning bar holding means. However, the mount is preferably formed at the first turning bar holding means and the connection means at the end of the turning bar. The mount is preferably open toward such a side that the connecting element enters and leaves the mount by a pivoting movement of the turning bar, which takes place in the plane of the web. The mount and the connecting element are preferably even shaped such that the connection can be established only by a pivoting movement in the plane of the web and it can also be separated only by such a pivoting movement, and the pivoting movement, which is mentioned here for the purpose of determining the mount, preferably accounts for only a small portion of the overall pivoting movement that the turning bar performs during the shifting.

The snap-in connection is advantageously secured by means of a locking element, which is tensioned into one locked position by the application of a force of elasticity. Such a locking means may be especially a linearly guided locking pin or a pivotable snap hook in the manner of a catch. The locking element advantageously has a symmetrical shape, such that the connecting element is moved into the mount by the pivoting movement of the turning bar and pushes the locking element out of the locked position against the force of elasticity, but it is reliably prevented from being moved out of its locked position by the turning bar pushing in the pivoting-out direction. For pivoting out, i.e., for separating the turning bar, the locking element must rather be moved out of the locked position by hand against the force of elasticity by being, e.g., pulled, pushed or pivoted.

The second turning bar holding means is preferably displaceable continuously freely and with low friction along the second guide. The second guide preferably forms a sliding guide for the second turning bar holding means.

In a preferred embodiment, the connection of the turning bar with the second turning bar holding means is formed by a hinge. The axis of rotation of the hinge preferably points vertically to the plane of the web when the turning bar is connected with the first turning bar holding means, so that the pivoting movement of the turning bar taking place in the plane of the web is made possible by the articulation of the turning bar with the second turning bar holding means.

The turning bar, which is separated from the first turning bar holding means but is still connected with the second turning bar holding means, is pivotable in a preferred embodiment not only in the plane of the web, but also out of the plane of the web. To make this pivoting movement possible, a drag hinge with a pivot axis extending in or in parallel to the plane of the web and pointing preferably at right angles to the direction of delivery of the web is formed. This drag hinge is preferably likewise designed as a hinge, preferably between the second turning bar holding means and the second guide, by the second guide forming the pivot axis and the second turning bar holding means forming a bush partially or completely surrounding the second guide. The hinge for the pivoting movement of the turning bar around the axis of rotation or pivot axis that is vertical to the plane of the web is preferably formed at an arm rigidly projecting from the bush.

It should also be mentioned in connection with the first guide and the first turning bar holding means that the first guide also forms a sliding guide for the first turning bar holding means in a preferred embodiment. The first turning bar holding means may have here especially a guide part that is shaped as a partial bush or preferably a full bush and partially or preferably completely surrounds the first guide and is guided slidingly with close tolerance at the first guide. The connection with the shiftable turning bar is preferably formed at an arm rigidly projecting from the guide part. If the first turning bar holding means is coupled with the adjusting means it has an engaging part, which engages the adjusting means. If the engagement is formed, as is preferred, with a threaded spindle of the adjusting mechanism, the engaging part forms a partial or full bush with an internal thread, which engages the thread of the threaded spindle. If the first turning bar holding means is formed by a plurality of first turning bar holders, each of the first turning bar holders preferably has such a design. The same applies analogously if the second turning bar holding means is coupled with the adjusting means or another adjusting means.

The present invention will be explained below on the basis of a preferred exemplary embodiment. The features that become apparent from the exemplary embodiment lead to the improvement of the subjects of the claims and also the features explained above in a preferred manner each individually and in any combination of features. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
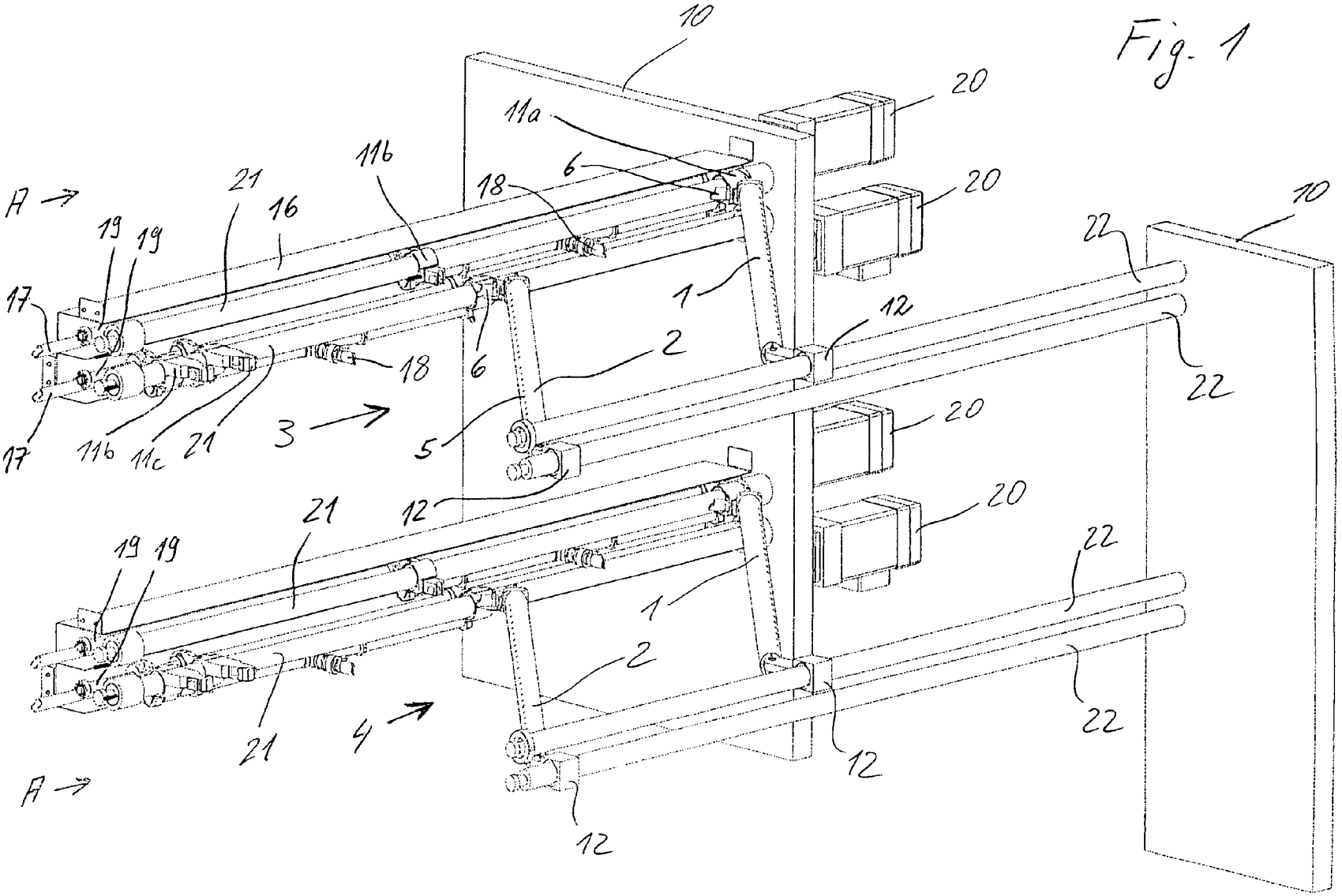
FIG. 1 is an initial configuration of a turning bar arrangement with shiftable turning bars.
Figure 2:
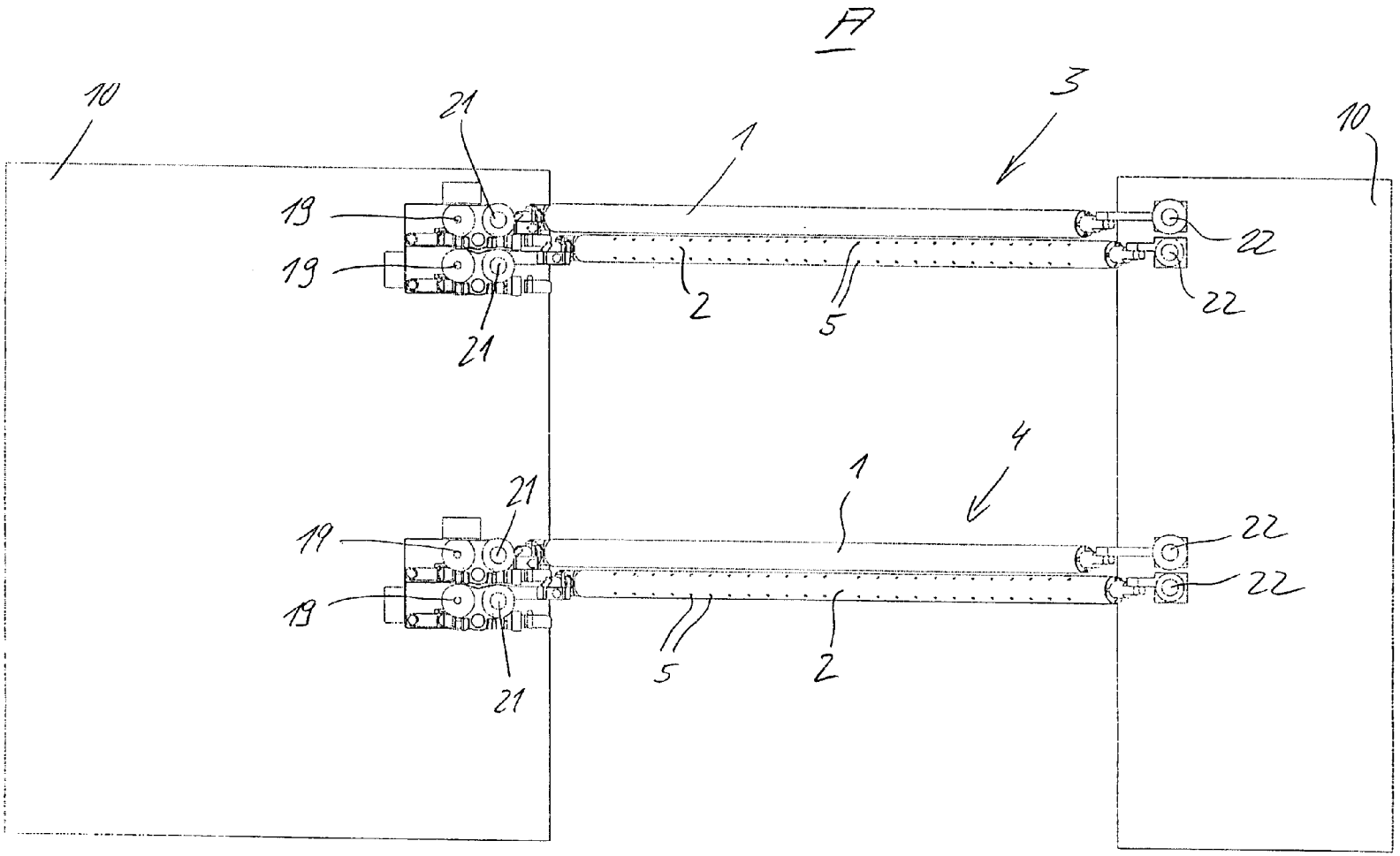
FIG. 2 is side view A of the turning bar arrangement from FIG. 1.

FIG. 1 shows a perspective view and FIG. 2 a side view A of a turning bar arrangement with two turning bar levels, namely, an upper level 3 and a lower level 4, which is used to merge printed web strands in a web-fed rotary printing press for printing large newspaper editions. The two turning bar levels 3 and 4 are formed by two turning bars 1 and 2 each and the means belonging to them for mounting and adjusting the turning bars 1 and 2. The turning bar levels 3 and 4 differ only by their arrangement, i.e., level 3 is arranged vertically above level 4, but they are otherwise identical to each other per se. With the exception of minor differences, which play no role for the present invention, the turning bars 1 and 2 of each level 3 and 4 and the respective means belonging to them for mounting and adjusting the turning bars 1 and 2 are also identical to each other.

The entire turning bar arrangement is mounted between two frame walls of the press, of which only the front frame wall 10 is shown (the other wall being substantially the same). Each of the turning bars 1 and 2 is connected with a first turning bar holder 11*a* at one of its two axial ends and with a second turning bar holder 12 at the other end. A first guide 21 and a second guide 22 each, which are designed as straight guides as usual in the exemplary embodiment, are associated with the turning bars 1 and 2. For each turning bar 1 and 2, the first turning bar holder 11*a* is guided slidingly with a close tolerance at the first guide 21, and the second turning bar holder 12 is guided slidingly with a close tolerance at the second guide 22. The guides 21 and 22 extend at right angles to the turning bars 1 and 2 and are fastened at their ends to the front frame wall 10 and the opposite frame wall (not shown) of the machine frame. The guides 21 and 22 are parallel to each other in pairs for each turning bar 1 and 2 and are each parallel to all other guides 21 and 22.

A second turning bar holder 12 is provided for each turning bar 1 and 2. The turning bar 1 or 2 is separated from its second turning bar holder 12 for maintenance or repair work only, especially for replacement, and is connected in this sense permanently to its second turning bar holder 12. However, a plurality of first turning bar holders are provided for each turning bar 1 and 2. Two first turning bar holders 11*a* and 11*b* are provided for each level 3 and 4 for the upper turning bar 1, while three first turning bar holders 11*a*, 11*b* and 11*c* are associated for each level 3 or 4 with the lower turning bar 2. Corresponding to their position, i.e., orientation in relation to the direction of delivery of the web, the upper turning bars 1 are connected either with the first turning bar holder 11*a* or with the second turning bar holder 11*b*. The lower turning bars 2 are likewise connected either with the first turning bar holder 11*a*, the first turning bar holder 11*b* or with the first turning bar holder 11*c*, corresponding to their position, i.e., orientation in relation to the direction of delivery of the web.

The turning bar holders 11*a* and 11*b* of the turning bars 1 and 2 differ only by the mount 13 formed on each of the turning bar holders 11*a* and 11*b*, which is shaped like an eye that is open on one side. If the turning bars 1 are connected with one of their first turning bar holders 11*a* and 11*b*, a connecting element 7 is accommodated in the mount 13 of the turning bar holder 11*a* or 11*b* in question, the connecting element 7 being formed for each turning bar 1 at the end of the turning bar facing the first guide 21.

Figure 11:
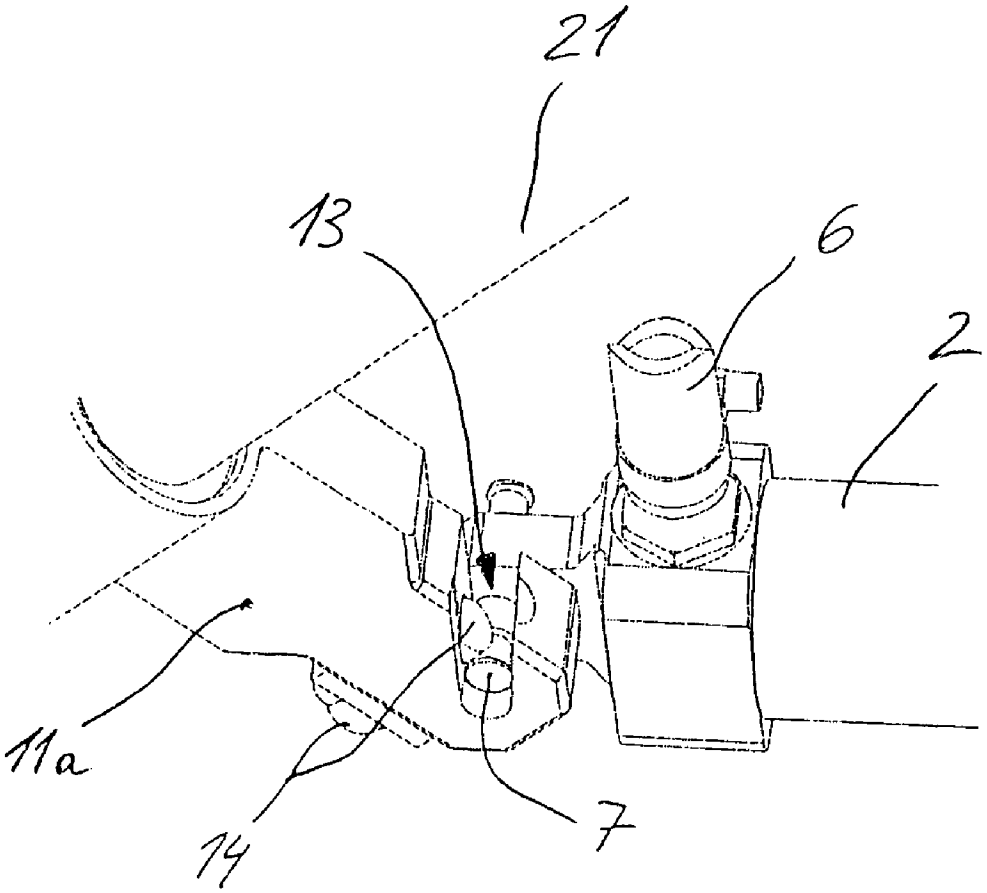
FIG. 11 is a perspective view showing the connection of one of the turning bars with a turning bar holder of a first turning bar holding means.

The connection is shown in detail in FIG. 11. The first turning bar holders 11*a*, 11*b* and 11*c* of the lower turning bar 2 are also identical to each other with the exception of the orientation of their respective mounts 13. The turning bar holder 11*c* corresponds to the turning bar holder 11*a*. The direction of the respective mount 13, which is different for the turning bar holders 11*a* and 11*b* of the turning bar 1 and the turning bar holders 11*a* through 11*c* of the turning bar 2, is used to facilitate the pivoting in and out of the corresponding turning bar 1 or 2 into the mount 13 of the respective first turning bar holder 11*a*, 11*b* or 11*c* which participates in the establishment of the connection. The mounts 13 used to pivot the turning bars 1 and 2 in and out are open on such a side that the associated turning bar 1 or 2 with its connecting element 7 can pivot into the mount 13 or out of the mount 13 only by a pivoting movement that takes place in its last or first part in the plane of the web.

The connection of the turning bars 1 and 2 with one of the associated first turning bar holders 11*a*, 11*b* and 11*c* each is possibly rigid, but it does, on the other hand, permit the quick separation and connection of the turning bars 1 and 2 with the first turning bar holder 11*a*, 11*b* or 11*c* with a few, simple movements without the use of a tool or other auxiliary means.

The first turning bar holders 11*a*, 11*b* and 11*c* each have a locking element 14, which is designed as a linearly guided locking bolt. The locking element 14 is tensioned by a force of elasticity, which is generated, for example, by a compression spring acting on the locking element 14, into a locked position, in which the connection existing between the turning bar 1 or 2 and one of the associated turning bar holders 11*a*, 11*b* or 11*c* is prevented from being separated.

The connection of the turning bars 1 and 2 with the particular associated first turning bar holder is shown in FIG. 11 for the turning bar 2, and this analogously also applies to the connection of the other turning bars with the first turning bar holder 11*a*. Any differences in the connections, those for the turning bar 1, on the one hand, and those for the turning bar 2, on the other hand, are irrelevant for the present invention. FIG. 11 shows the turning bar 2 and the first turning bar holder 11*a* in the connected state. The connecting element 7 of the turning bar 2 is accommodated in the mount 13 with close tolerance and is secured by the locking element 14, which is in its locked position. The securing is ensured by the fact that the locking element 14 locks the open side of the mount 13 by protruding somewhat into the mount 13, so that it comes to lie in front of the connecting element 7 when viewed from the open side of the mount 13. The locking element 14 has an asymmetric shape at its end protruding into the mount 13, such that its front side facing the open side of the mount 13 tapers toward the free end of the locking element 14, while its rear side facing the connecting element 7 has such a shape that reliably prevents the turning bar 2 with its connecting element 7 from being able to be pivoted out of the mount 13 by a force acting in the pivoting-out direction alone. Due to the taper of the locking element 14 on the front side, the turning bar 2 can, by contrast, be pivoted into the mount 13 and consequently into the connection with the turning bar holder 11*a*, without an actuation of the locking element 14, which actuation would release the locked position, being needed. The locking element 14 is rather pushed simply out of the locked position against the force of elasticity (spring force) by the pivoted-in connecting element 7, but it snaps forward again by itself into the locked position behind the pivoted-in connecting element 7 when the connecting element 7 has passed by the locking element 14 during pivoting in. To separate the connection, the locking element is moved manually out of the mount 13 by a sufficient amount and thus out of the locked position against the force of elasticity.

Each of the first turning bar holders 11*a* through 11*c* is adjustable by means of a motor along its first guide 21. The adjustment is brought about by means of an adjusting means, which has its own separate adjusting motor 20 and an adjusting mechanism for each turning bar 1 and 2. Each of the adjusting mechanisms comprises a threaded spindle 19, which extends in parallel to the respective first guide 21 associated with it. The first turning bar holders 11*a*, 11*b* and 11*c* form a screw joint with the respective threaded spindle 19 associated with them, so that an adjusting movement of the first turning bar holders 11*a*, 11*b* and 11*c* along the first guide 21 is brought about during the rotary driving of the spindles 19 because of the first turning bar holders 11*a*, 11*b* and 11*c* being guided at the first guide 21. The motors 20 are coupled with their respective associated threaded spindles 19 via a reducing gear.

The first turning bar holders 11*a* and 11*b* of the upper turning bar 1 are guided by the same first guide 21. They form, furthermore, a screw joint each with the same adjusting spindle 19, i.e., they are adjusted together and maintain their distance measured in the direction of the first guide 21 during the adjustment. This distance is half the total length of the first guide 21 that is available for the adjustment, at which said first guide 21 the first turning bar holders 11*a* and 11*b* of the upper turning bar 1 are guided. Due to the arrangement of a pair of first turning bar holders 11*a* and 11*b*, it is thus possible not only to optimally orient the opening of the mount 13, which opening is necessary for pivoting in and pivoting out, but also to reduce the path of adjustment to be traveled for the adjustment compared with the arrangement of only a single first turning bar holder 11*a* or 11*b* for each turning bar 1. The conditions are the same for the first turning bar holders 11*a*, 11*b* and 11*c* of the lower turning bars 2, the turning bar holder 11*c* being provided especially for so-called three-funnel productions.

To reduce or ideally eliminate frictional forces between the turning bars 1 and 2 and the webs or web strands of a web cut lengthwise, which are wrapped around them, air is blown around the turning bars 1 and 2. The air blast reaches the surface of the turning bars 1 and 2 through air blast holes 5. The turning bars 1 and 2 are correspondingly hollow, so that the air blast enters the hollow turning bars 1 and 2 via an air blast connection 6 and from there the surface of the turning bar 1 and 2 in question via the air blast holes 5 and thus under the web or the web strand. The air blast supply also comprises, furthermore, an air blast line 17 each for each turning bar 1 and 2, which extends over the length of the first guide 21 belonging to the respective turning bar 1 and 2, and an air blast connection pipe 18, which is connected with the air blast connection 6 of the turning bar 1 and 2 in question, is branched off from it, the figures not showing the flexible connection between the air blast connections 6 and 18. The air blast holes 5 are formed for each turning bar 1 and 2 on a hemisphere of the regular cylindrical surface only. The regular cylindrical jackets of the turning bars 1 and 2 are correspondingly rotatable around the longitudinal axes of the turning bars 1 and 2 in order for the air blast holes 5 to be able to rotate in all positions of the turning bars 1 and 2 into the particular circumferential area being wrapped around by the web or the web strand. The connection may be established especially between two locked positions, into which the rotatable jackets of the turning bars 1 and 2 are rotated during an adjustment of the turning bars 1 and 2 corresponding to the guiding of the web. It would also be possible to provide the turning bars 1 and 2 with a friction-reducing coating instead of air blast holes 5 and the corresponding air blast supply. However, the air blast supply is preferred.

Figure 3:
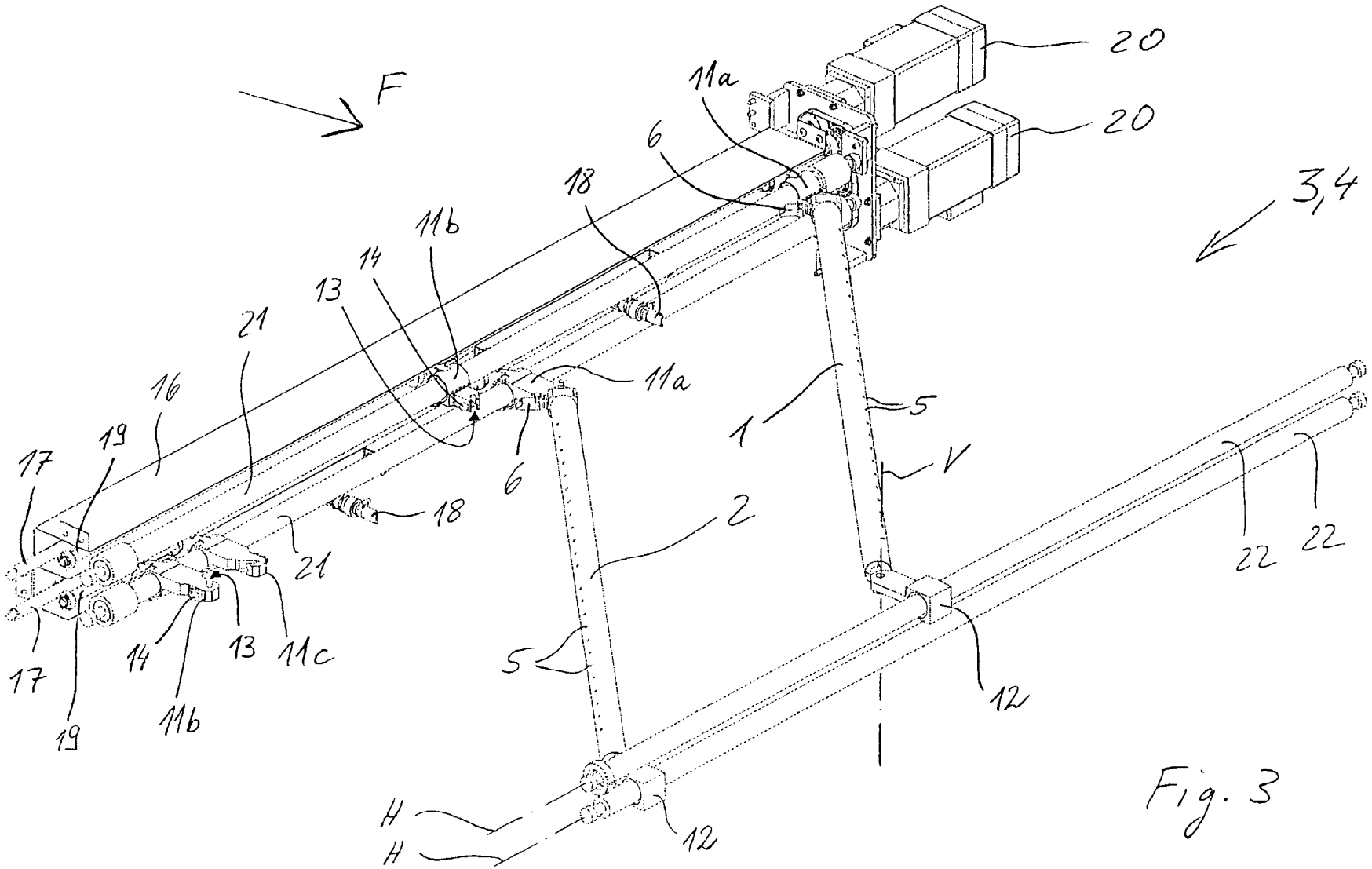
FIG. 3 is the upper level of the turning bar arrangement according to FIG. 1 with two shiftable turning bars, which assume the starting position shown in FIG. 1 each.

FIG. 3 shows an individual turning bar level of the turning bar levels 3 and 4 in the same state as FIGS. 1 and 2. In this state, the two turning bars 1 and 2 of level 3 or 4 are parallel to each other and have a distance measured in the direction of the guides 21 and 22 between them. The turning bars 1 and 2 are connected each with their first turning bar holders 11*a*.

It is assumed that the web or the web strand enters the turning bar level 3 or 4 in the direction of delivery F on the side of the adjusting motors 20. If only the term (web) will hereinafter be used, this term shall also apply to a web strand, which was obtained by the lengthwise cutting of a web having the width of a plurality of strands. In the case of the hypothetical direction of delivery F, the web first runs over the upper turning bar 1, wraps around the turning bar 1 and runs onto the lower turning bar 2 exactly at right angles to the original direction of delivery F, wraps likewise around the turning bar 2 and is turned as a whole as a result. The web undergoes a parallel offset away from the side with the adjusting motors 20 due to wrapping around the pair of turning bars 1 and 2. The web thus turned is half as wide in the exemplary embodiment as the turning bar levels 3 and 4 or narrower, e.g., it is one third their width.

If the turning bar level 3 or 4 is to be used in another print production to turn a web with half a width, which enters the turning bar level 3 or 4 on the side facing away from the adjusting motors 20, both turning bars 1 and 2 of the level 3 or 4 are shifted correspondingly. The orientation of the turning bars 1 and 2 is changed by the shifting by 90° when viewed in the plane of the web.

Figure 4:
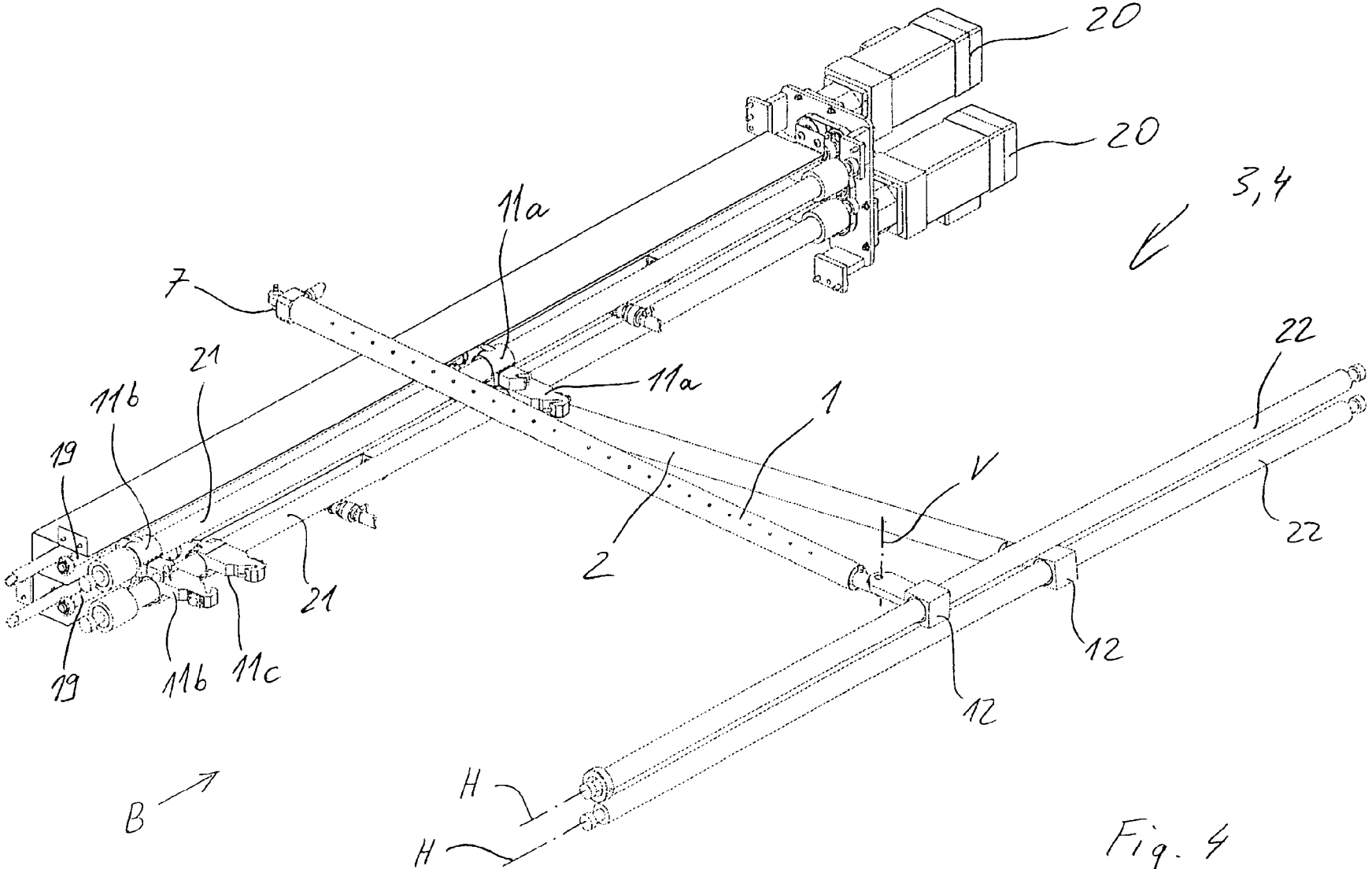
FIG. 4 is a perspective view showing the two turning bars according to FIG. 3 during a first shifting operation.
Figure 5:
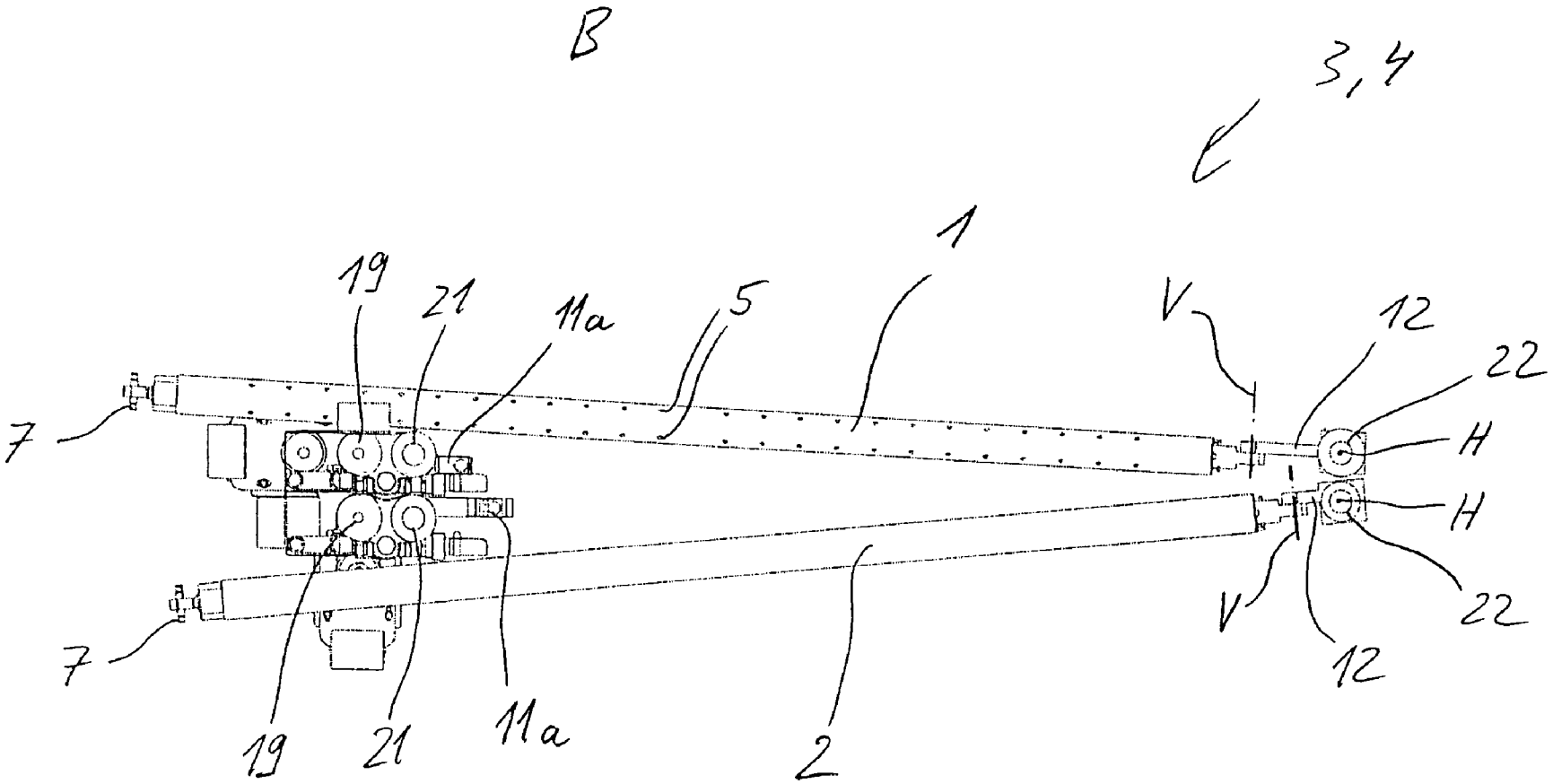
FIG. 5 is the side view B of FIG. 4.

FIGS. 4 and 5 show the transition from the initial configuration according to FIG. 3 to a first new configuration. The initial configuration and the first new configuration are turning configurations.

Figure 6:
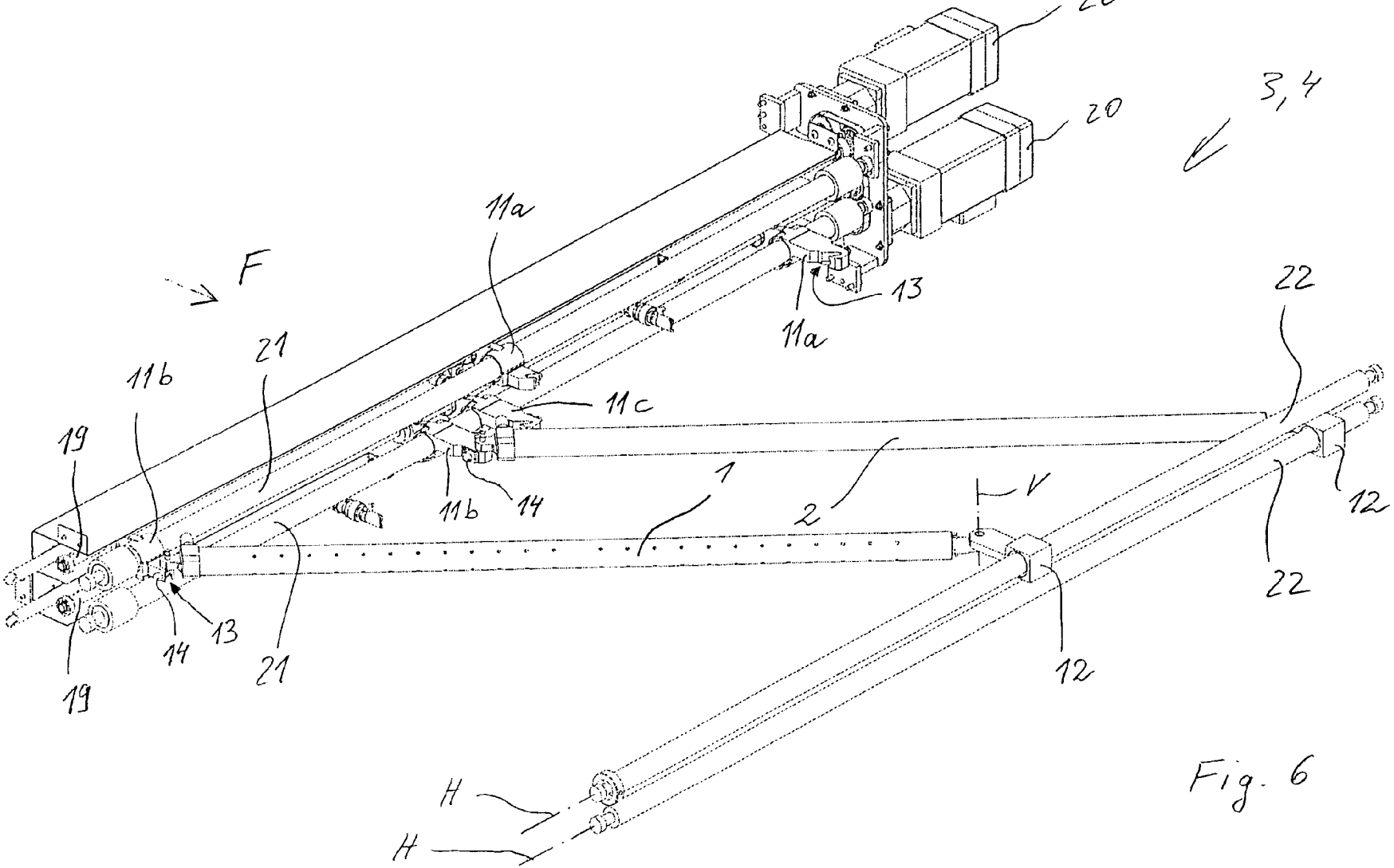
FIG. 6 is a perspective view showing the upper level of a first new configuration after the conclusion of a shifting operation.
Figure 7:
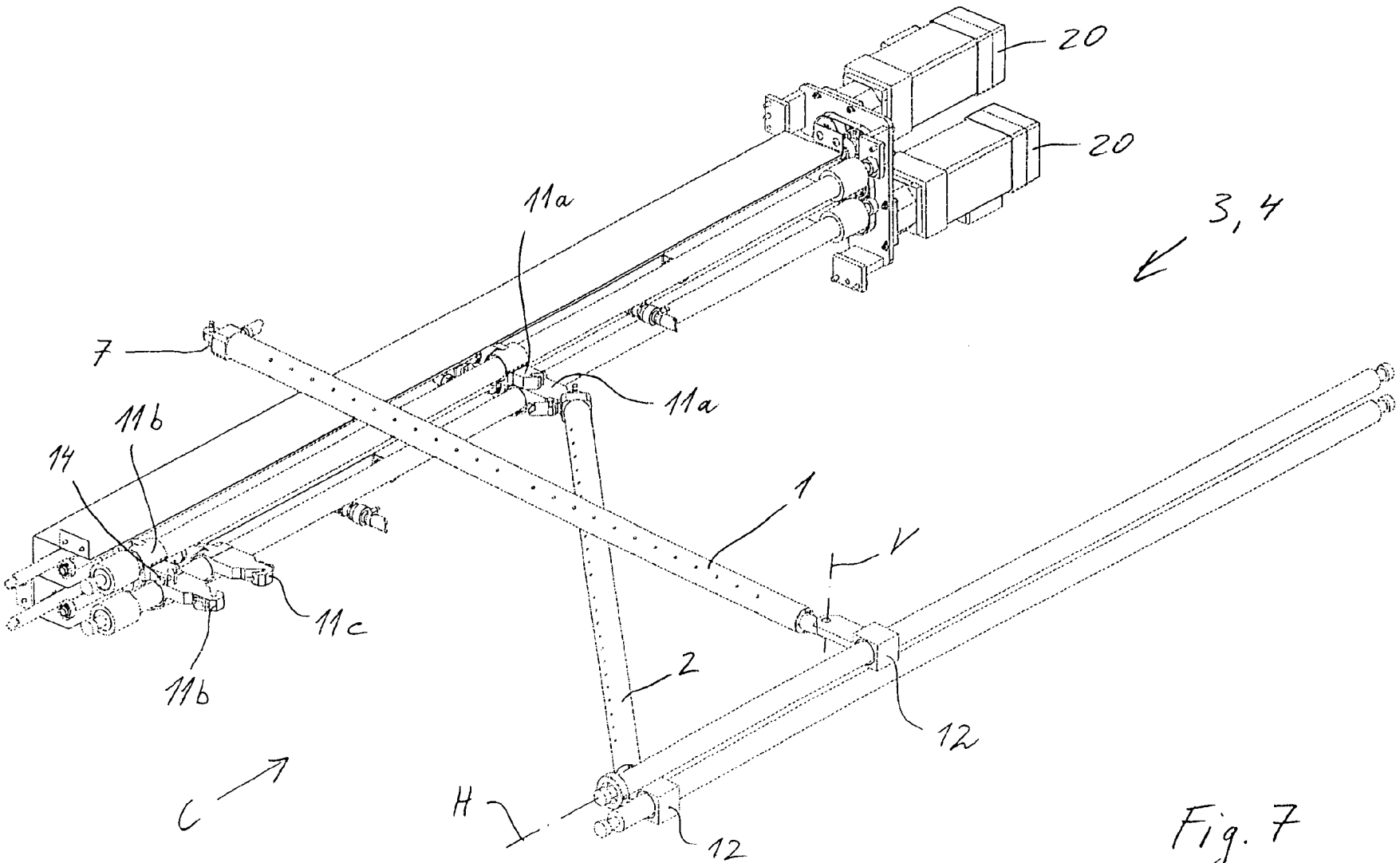
FIG. 7 is a perspective view showing the two turning bars according to FIG. 3 during another shifting operation, during which only one of the turning bars is shifted.
Figure 8:
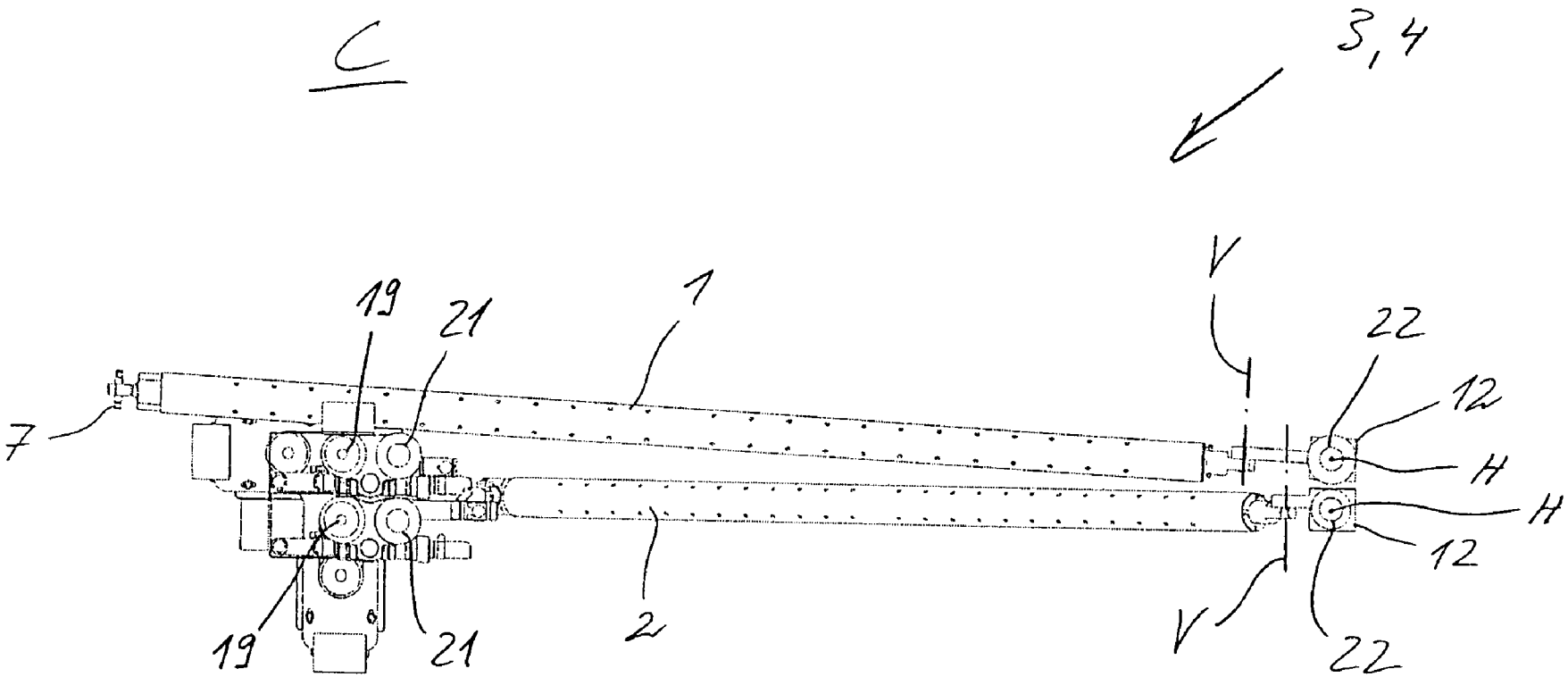
FIG. 8 is a side view showing the turning bars in side view C of FIG. 7.

FIG. 6 shows the turning bar level 3 or 4 in the first new configuration, in which the turning bars 1 and 2 are again parallel to each other, but in an orientation turned by 90°, when viewed in the plane of the web.

The turning bars 1 and 2 are pivoted during shifting by the superimposition of a pivoting movement in the plane of the web and a pivoting movement out of the plane of the web. A pure pivoting movement in the plane of the web is not possible in the exemplary embodiment. For the superimposed pivoting movement, the turning bars 1 and 2 form a first hinge each due to the connection with their associated second turning bar holder 12. These hinges form axes of rotation V, which point vertically to the plane of the entering web in the operating state, i.e., when the turning bars 1 and 2 are connected with the first turning bar holders 11*a*, 11*b* or 11*c* associated with them. One second hinge each is formed by the second turning bar holders 12 and the respective second guide 22 associated with it. The axes of rotation H of the second hinges extend in the plane of the entering web, which coincides, in general, with the horizontal, but this is not absolutely necessary. The axes of rotation H are at the same time also the central longitudinal axes of the second guides 22, which have a regular cylindrical shape in the exemplary embodiment. To form the second hinge with the associated second guide 22, the second turning bar holders 12 have a guide part each, which forms a sliding bush, which completely and closely surrounds the associated guide 22. A short arm each projects rigidly from the guide part of each turning bar holder 12 in the direction of the opposite first guide 21. The first hinge, i.e., the hinge for the pivoting movement in the plane of the entering web, is formed at each of the second turning bar holders 12 at the projecting arm of the holder. In the exemplary embodiment, the projecting arms are provided with a hole each pointing in the direction of the axis of rotation V of the joint in question. A pin is correspondingly formed in a projecting manner at the end of the associated turning bar 1 or 2 at right angles to the longitudinal axis of the turning bar 1 or 2, the pin being accommodated in the hole of the associated turning bar holder 12 in a rotatable manner. A double joint each with the axes of rotation and pivoting H and V is thus obtained for each turning bar 1 and 2 with the turning bar 1 or 2, the associated second turning bar holder 12 and the associated second guide 22 as joint elements.

The transformation of the initial configuration according to FIG. 3 into the first new configuration according to FIG. 6 will be described below on the basis of FIGS. 3 through 6, and the transformation of the configuration according to FIG. 3 into a second configuration will be described on the basis of FIGS. 3 and 7 through 9.

For the transformation, an operator enters directly the area of the turning bars 1 and 2 through the frame wall 10 interrupted between the guides 21 and 22 and manually separates the respective connections of the turning bars 1 and 2 with the associated first turning bar holder 11*a*, doing so by pulling the locking elements 14 and pivoting the turning bars 1 and 2 out of the mounts 13. After separating the two connections, the upper turning bar 1 is pivoted upward out of the plane of the entering web, and the lower turning bar 2 is pivoted out downward around the respective pivot axis H, as is apparent from FIGS. 4 and 5. The turning bars 1 and 2, which have been pivoted out of the plane of the web, are subsequently pivoted by 90° each around the pivot axes V, which are slightly tilted in relation to the plane of the entering web. Before, during or after this superimposed pivoting movement is performed for each turning bar 1 and 2, but, of course, after the manual separation of the connections, the first turning bar holders 11*a* and 11*b* of the upper turning bar 1 are adjusted together by means of the associated adjusting means 19, 20 by the maximum path of adjustment away from the adjusting motors 20 in the direction of the opposite frame wall into their positions 19 that are the outermost positions for this direction of adjustment, and are fixed in their new positions by means of the associated adjusting means 19, 20 and thereby positioned. With the adjusting spindle 19 fixed, the fixing is brought about by the adjusting engagement in the respective screw joint. The first turning bar holders 11*a* through 11*c* of the lower turning bar 2 are also adjusted together by means of the adjusting means 19, 20, but they are adjusted in the opposite direction toward the adjusting motors 20 into their positions that are the outermost positions for this direction. After the first turning bar holders 11*a* through 11*c* have assumed the new positions, the turning bars 1 and 2 are connected with the one of the associated first turning bar holders 11*a* through 11*b* as well as 11*a* through 11*c* that assumes the position corresponding to the new configuration. This is the turning bar holder 11*b* facing away from the side of the adjusting motors 20 for the upper turning bar 1, and this is the turning bar holder 11*b* facing farthest away from the side of the adjusting motors 20 for the lower turning bar 2.

The second turning bar holders 12 are slidingly displaced at their second guides 22 already during the superimposed pivoting movement. The sliding guide between the second guides 22 and the second turning bar holders 12 advantageously has a low friction, but is tight for this in order for the turning bar holders 12 to be able to move possibly without jerks along the second guides 22. The adjustment of the positions of the second turning bar holders 12 may be performed directly at the second turning bar holders 12. However, the turning bars 1 and 2 may also be used as linkages of bars for the adjustment of the second turning bar holders 12. It is advantageous for this if the distance between the joint axes H and the guides 22 and consequently the lever arms acting when the turning bars 1 and 2 are used as linkages of bars are as short as possible.

During the shifting, the operator turns, furthermore, the jackets of the turning bar 1 and 2, which are provided with the air blast holes 5, by 180° each, as can be recognized from a comparison of FIGS. 3 and 6 and especially from a comparison of the views in FIGS. 2 and 5. The turning bars 1 and 2 are provided for this purpose with locking means, which form the corresponding locked positions for the turning bar jackets for each turning bar 1 and 2.

The connection between the turning bars 1 and 2 and their new holders 11*b* is brought about by slightly pivoting back the turning bars 1 and 2 and pivoting them into the mount 13 of the respective associated turning bar holder 11*b*. Pivoting in alone is sufficient to push the locking elements 14 of the turning bar holders 11*b* out of the path of the connecting element 7 and thus out of the locked position. The locking elements 14 snap back again behind the pivoted-in connecting element 7, so that the turning bars 1 and 2 are secured at the turning bar holders 11*b*, and the connections are established.

The shifting of the turning bars 1 and 2 may be performed simultaneously. However, the turning bars 1 and 2 are preferably shifted one after another.

Figure 9:
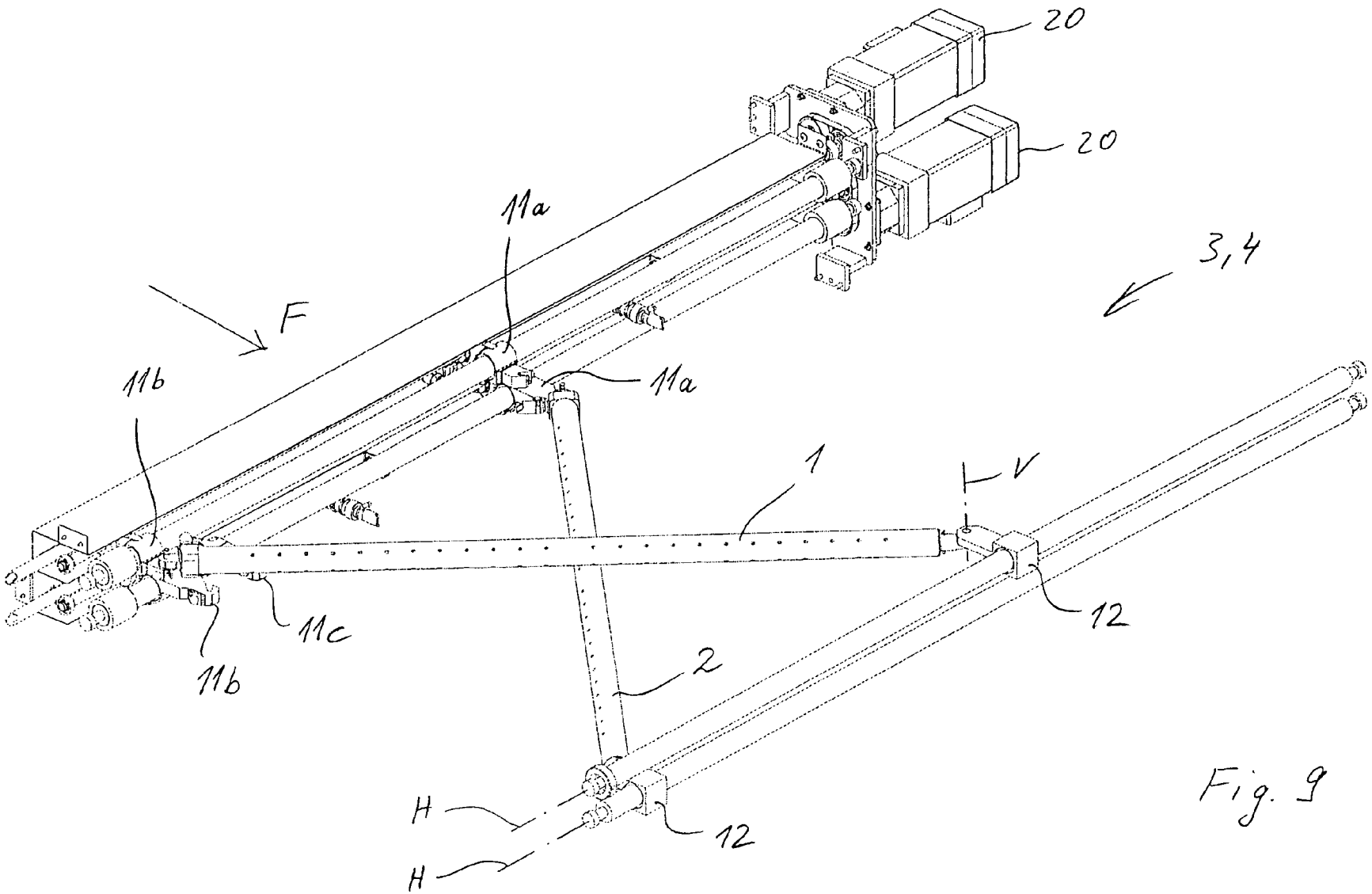
FIG. 9 is a perspective view showing the, upper level in a second new configuration after the conclusion of the second shifting operation.

FIG. 9 shows the turning bars 1 and 2 in a turn-around configuration. By wrapping around the upper turning bar 1 by 90°, a web, which has half the maximum width or an even smaller width, for example, one third width, and which enters on the side facing away from the adjusting motors 20, is led in this second new configuration from the direction of delivery F of the entering web onto a deflecting means, for example, a deflecting roller, which is arranged on the side of the adjusting motors 20. While wrapping around the deflecting means, the deflected web is led back into the turning bar level 3 or 4 and onto the lower turning bar 2, it wraps around the lower turning bar 2, and leaves the turning bar level 3 or 4 while maintaining the direction of delivery F of the entering web but with the top side and the underside turned around.

Only the upper turning bar 1 must be shifted to transform the turning configuration according to FIG. 3 into the turn-around configuration according to FIG. 9, while the lower turning bar 2 maintains its position, including its orientation. The position of the upper turning bar 1 corresponds in the turn-around configuration to the position in the turning configuration according to FIG. 6. The same movements and motor adjustments are correspondingly performed for the upper turning bar 1 as in the case of the transformation from the turning configuration according to FIG. 3 into the turning configuration according to FIG. 6.

Figure 10:
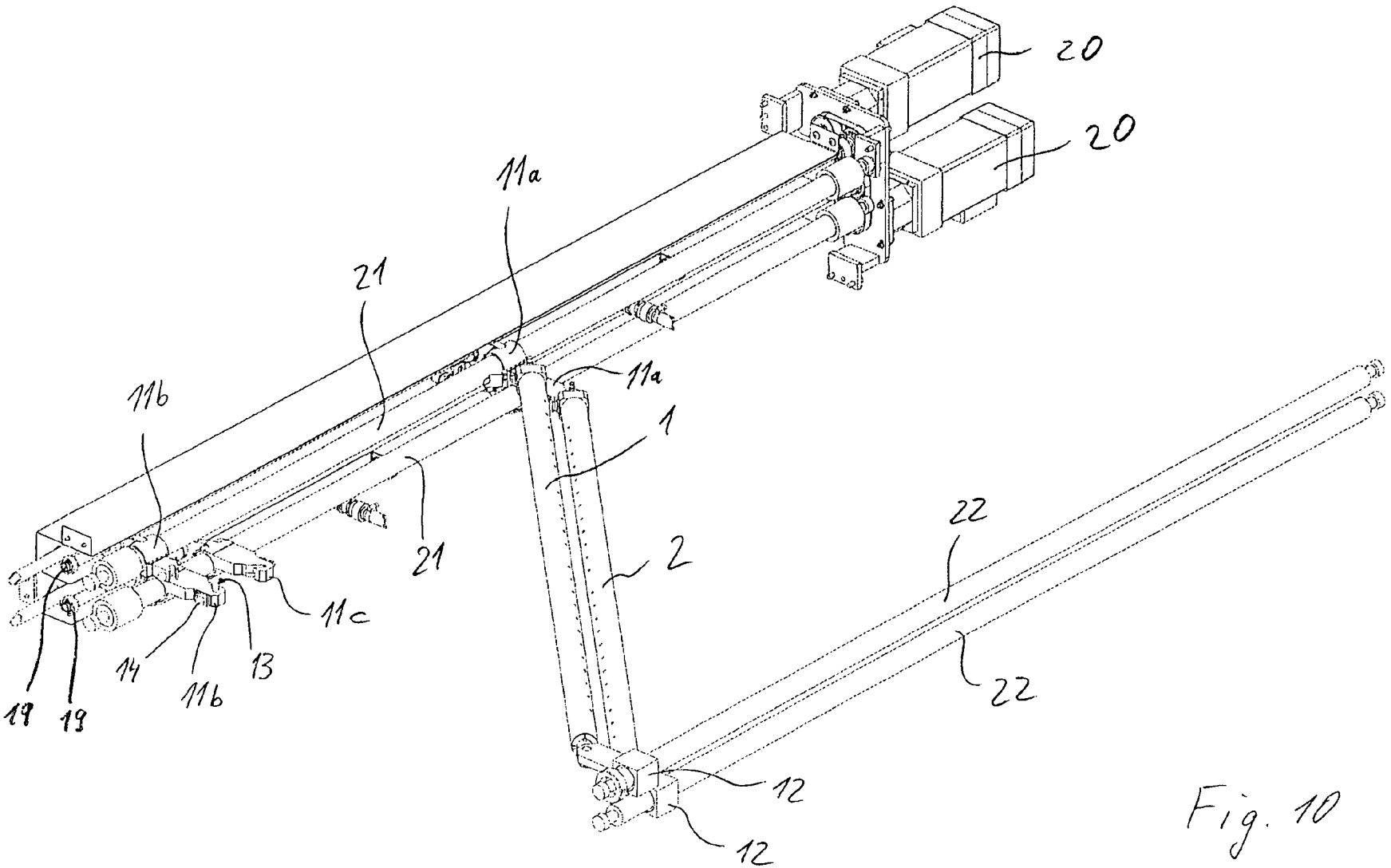
FIG. 10 is a perspective view showing s the upper level in a third, new configuration after a parallel offset of one of the two turning bars.

The configuration according to FIG. 10 is obtained from the configuration according to FIG. 3 by simply displacing the upper turning bar 1 in parallel to itself, while the lower turning bar 2 maintains the position it assumed in the configuration according to FIG. 3. The offset movement of the upper turning bar 1 is carried out without taking out the turning bar 1. The parallel offset is thus brought about by the adjusting means 19, 20 alone. It must, of course, be ensured that the second turning bar holder 12 cannot jam during the offset movement. Instead of bringing about the parallel offset by means of the adjusting means 19, 20, it would also be possible to separate the turning bar 1 in question manually from the first turning bar holder 11*a*, then to adjust the first turning bar holder 11*a* by means of the adjusting means 19, 20 and the second turning bar holder 12 manually and finally to connect the turning bar 1 again manually with the first turning bar holder 11*a*, which is in the new position. Thus, either an automatic/manual adjustment or a fully automatic adjustment may be performed as desired during the parallel offset. The fully automatic adjustment is preferred for the parallel offset.

The exemplary embodiment shows how a simple and therefore inexpensive turning bar arrangement, which can be configured in a substantially more convenient manner and in a shorter time compared with a purely manual shifting of the turning bars, can be created by a combination of manual and automatic adjustment performed by means of adjusting motors. The set-up for a new production is considerably reduced at a comparatively low cost. It would be possible to reduce the cost by replacing each of the adjusting motors 20 with a hand crank. However, such a purely manual solution may easily lead to a marked increase in the time needed for the shifting, especially if a plurality of turning bars must be shifted during a set-up.

While a specific embodiment of the invention has been shown and described in detail to illustrate the application of the principles of the invention, it will be understood that the invention may be embodied otherwise without departing from such principles.

What is claimed is:

1. A device for deflecting a web, comprising:

a shiftable turning bar;

a first turning bar holding means connected with one axial end of said turning bar for holding said turning bar;

a second turning bar holding means connected with the other axial end of said turning bar for holding said turning bar;

a first guide, said first turning bar holding means being guided movably along said first guide;

a second guide, said second turning bar holding means being guided movably along said second guide;

an adjusting means for adjusting at least one of said first turning bar holding means along said first guide and said second turning bar holding means along said second guide in order to position said at least one of said first turning bar holding means and said second turning bar holding means for the shifting of said turning bar;

a manually operable connection between said turning bar and said first turning bar holding means for manual separation and establishing a connection manually in order to separate said turning bar manually from said first turning bar holding means during a shifting of said turning bar and to connect said turning bar manually with said first turning bar holding means positioned in a shifted position, a mount formed at one of said turning bars and said first turning bar holding means, a connecting element accommodated in said mount and formed at the other of said turning bar and said turning bar holding means, said mount being open on one side such that said connecting element pivots into said mount and pivots out of said mount, and a locking element movably connected with said mount and tensioned by means of a force of elasticity into a locked position, said locking element protruding into or through said mount on an open side of said mount when said connecting element is accommodated in said mount, said locking element being shaped such that said locking element is pushed out of the locked position by said connecting element against the force of elasticity due to a pivoting in, so as to make pivoting in without additional movements, said locking means and a connecting element being accommodated in said mount to prevent separation of the connection of said turning bar with said first turning bar holding means.

2. A device in accordance with claim 1, wherein said adjusting means comprises an adjusting motor for adjusting said at least one of said first turning bar holding means and said second turning bar holding means.

3. A device in accordance with claim 1, wherein said adjusting means comprises an adjusting spindle with which said at least one of said first turning bar holding means and said second turning bar holding means can be adjusted by means of a screw joint for adjustment along a joint axis.

4. A device in accordance with claim 1, wherein said connection of said turning bar with said first turning bar holding means is a snap-in connection.

5. A device in accordance with claim 1, wherein said mount is open on such a side that said connecting element can be pivoted into said mount and can be pivoted out of said mount in or parallel to the plane of a web entering the device.

6. A device in accordance with claim 1, wherein one of said first turning bar holding means and said second turning bar holding means is fixed along its respective said guide by the other of said first turning bar holding means and said second turning bar holding means as positioned by said adjusting means via said turning bar when said turning bar is connected with said other of said first turning bar holding means and said second turning bar holding means.

7. A device in accordance with claim 1, wherein one of said first turning bar holding means and said second turning bar holding means is displaceable along its said guide.

8. A device in accordance with claim 1, wherein said second turning bar holding means is freely displaceable.

9. A device in accordance with claim 1, wherein at least one of said first turning bar holding means and said second turning bar holding means is guided slidingly and with a close tolerance at a respective said guide.

10. A device in accordance with claim 1, wherein said turning bar is pivotable relative to said second guide around two axes.

11. A device in accordance with claim 1, wherein said turning bar is mounted by means of said second turning bar holding means such that it is pivotable around an axis that points at right angles to the plane of a web entering the device in relation to the position that said turning bar assumes when it is connected with said first turning bar holding means and said second turning bar holding means.

12. A device in accordance with claim 11, wherein said turning bar is connected with said second turning bar holding means pivotably around said axis.

13. A device in accordance with claim 1, wherein said turning bar is mounted pivotably by means of said second turning bar holding means such that said turning bar can be pivoted out of a plane of the web entering the device when the connection with said first turning bar holding means is separated.

14. A device in accordance with claim 13, wherein to achieve the pivotability out of the plane of the web, said second turning bar holding means is mounted pivotably around an axis (H) that points in the same direction as or in a direction parallel to a respective said guide.

15. A device in accordance with claim 1, wherein said second turning bar holding means and said second guide form a hinge.

16. A device in accordance with claim 1, wherein said turning bar is mounted by means of said second turning bar holding means such that said turning bar can perform a superimposed pivoting movement around two axes, which are at right angles to each other, when the connection of said turning bar with said first turning bar holding means is separated, wherein one of said two axes points vertically to a plane of the web entering the device and said other of said axes points in or parallel to a plane of the entering web and at right angles to the direction of delivery of the web, always relative to the position that said turning bar assumes as long as it is connected with said first turning bar holding means and said second turning bar holding means.

17. A device in accordance with claim 1, wherein said first turning bar holding means comprises at least two first turning bar holders with at least one of said two first turning bar holders guided movably along said first guide and coupled with said adjusting means so that said at least one of said two first turning bar holders can be adjusted along said first guide by means of said adjusting means and can be positioned for the shifting of said turning bar.

18. A device in accordance with claim 17, wherein the other of said two first turning bar holders is also guided along said first guide and is coupled with said adjusting means such that said other of said two first turning bar holders can be adjusted and positioned by means of said adjusting means along said first guide.

19. A device in accordance with claim 1, wherein said first turning bar holding means comprises at least two first turning bar holders and said adjusting means couples said two first turning bar holders with one another such that they can be adjusted together by means of said adjusting means.

20. A device in accordance with claim 1, wherein said first turning bar holding means comprises at least two first turning bar holders and during the shifting said turning bar is separated from one of said two first turning bar holders and is connected with said positioned other of said two first turning bar holders.

21. A device in accordance with claim 1, further comprising another turning bar, said another turning bar cooperating with said turning bar to form a turning bar pair for turning and/or turning around a web together with said turning bar.

22. A device in accordance with claim 21, wherein said another turning bar is a turning bar that is shiftable.

23. A device in accordance with claim 21, further comprising another turning bar pair.

* * * * *

UNITED STATES PATENT AND TRADEMARK OFFICE

CERTIFICATE OF CORRECTION

PATENT NO. : 7,201,300 B2
APPLICATION NO. : 10/785265
DATED : April 10, 2007
INVENTOR(S) : Buri et al.

It is certified that error appears in the above-identified patent and that said Letters Patent is hereby corrected as shown below:

Title Page, Item (73) Assignee: should read

(73) Assignee: WIFAG Maschinenfabrik

Signed and Sealed this

Twenty-fourth Day of July, 2007

JON W. DUDAS
*Director of the United States Patent and Trademark Office*